US012280317B1

(12) United States Patent
Plemmons

(10) Patent No.: US 12,280,317 B1
(45) Date of Patent: Apr. 22, 2025

(54) STRING TOY KIT

(71) Applicant: Clay Plemmons, Candler, NC (US)

(72) Inventor: Clay Plemmons, Candler, NC (US)

( * ) Notice: Subject to any disclaimer, the term of this patent is extended or adjusted under 35 U.S.C. 154(b) by 846 days.

(21) Appl. No.: 17/487,069

(22) Filed: Sep. 28, 2021

(51) Int. Cl.

| | |
|---|---|
| ***A63H 21/02*** | (2006.01) |
| ***B61B 7/00*** | (2006.01) |
| ***B61B 12/00*** | (2006.01) |
| ***B61B 12/02*** | (2006.01) |

(52) U.S. Cl.
CPC ..... *A63H 21/02* (2013.01); *B61B 7/00* (2013.01); *B61B 12/007* (2013.01); *B61B 12/028* (2013.01)

(58) Field of Classification Search
CPC ..... A63H 21/02; A63H 27/04; B61B 12/007; B61B 7/00; B61B 12/028
See application file for complete search history.

(56) References Cited

U.S. PATENT DOCUMENTS

| | | | | | |
|---|---|---|---|---|---|
| 2,083,218 | A * | 6/1937 | Carter | A63H 21/02 | 104/93 |
| 2,599,227 | A * | 6/1952 | Brown | A63H 21/02 | 446/274 |
| 3,693,290 | A * | 9/1972 | Breslow | A63H 21/02 | 273/351 |
| 3,793,764 | A * | 2/1974 | Gagnon, Sr. | A63H 33/30 | 446/228 |
| 3,864,868 | A * | 2/1975 | Wolf | A63H 27/04 | 446/229 |
| 4,044,497 | A | 8/1977 | Bettens | | |
| 4,266,369 | A * | 5/1981 | Spector | A63H 21/02 | 472/7 |
| 4,522,605 | A * | 6/1985 | Guay, Jr. | A63H 21/02 | 446/228 |
| 6,110,004 | A * | 8/2000 | McKinley | A63H 33/00 | 446/490 |
| 6,189,455 | B1 * | 2/2001 | Thompson | B66C 21/00 | 104/126 |
| 8,393,100 | B1 * | 3/2013 | Hrehoriak | G09F 19/00 | 472/6 |
| 2010/0099506 | A1 | 4/2010 | Tenbrunsel | | |

FOREIGN PATENT DOCUMENTS

| | | |
|---|---|---|
| EP | 0072260 | 4/1983 |
| GB | 1325516 | 8/1973 |

* cited by examiner

*Primary Examiner* — Zachary L Kuhfuss
*Assistant Examiner* — Cheng Lin
(74) *Attorney, Agent, or Firm* — Kyle A. Fletcher, Esq.

(57) ABSTRACT

The string toy kit is a toy. The string toy kit is a vehicle. The vehicle formed by the string toy kit is often referred to as a zip line. The vehicle formed by the string toy kit is suspended above a supporting surface. The string toy kit comprises a base wall mount, a tension wall mount, a one or more corner guides, a zip line structure and a chamber. The zip line structure is suspended from the base wall mount, and tension wall mount, and the one or more corner guides. The chamber comprises a plurality of walls, one or more corners, and a ceiling. The base wall mount, the tension wall mount, and the one or more corner guides mount on the plurality of walls of the chamber.

12 Claims, 6 Drawing Sheets

FIG. 2
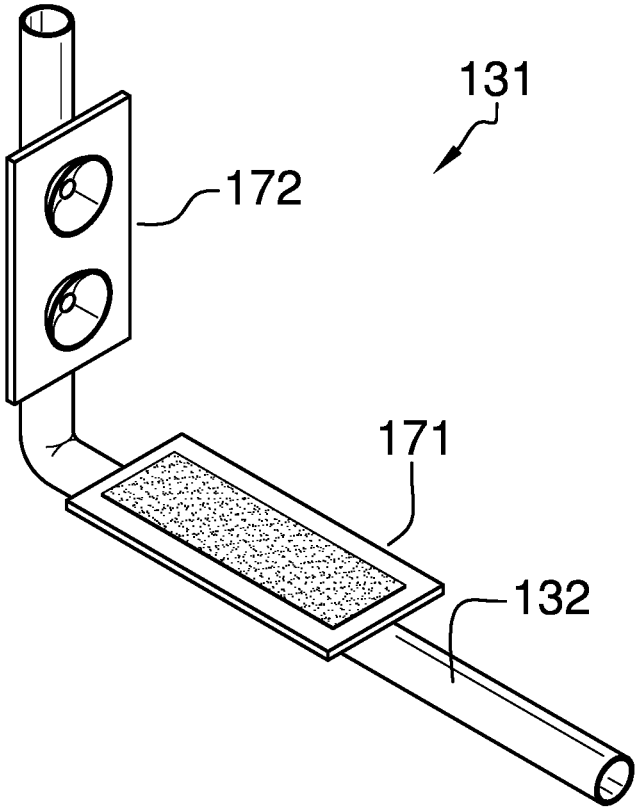
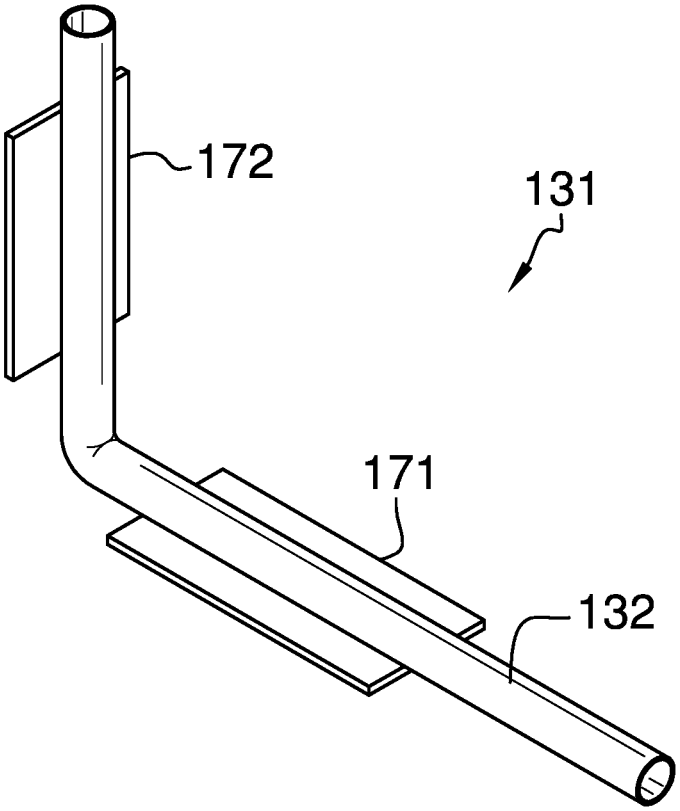
FIG. 3

STRING TOY KIT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of suspended vehicles. (B61B3/02)

SUMMARY OF INVENTION

The string toy kit is a toy. The string toy kit is a vehicle. The vehicle formed by the string toy kit is often referred to as a zip line. The vehicle formed by the string toy kit is suspended above a supporting surface. The string toy kit comprises a base wall mount, a tension wall mount, a one or more corner guides, a zip line structure and a chamber. The zip line structure is suspended from the base wall mount, and tension wall mount, and the one or more corner guides. The chamber comprises a plurality of walls, one or more corners, and a ceiling. The base wall mount, the tension wall mount, and the one or more corner guides mount on the plurality of walls of the chamber.

These together with additional objects, features and advantages of the string toy kit will be readily apparent to those of ordinary skill in the art upon reading the following detailed description of the presently preferred, but nonetheless illustrative, embodiments when taken in conjunction with the accompanying drawings.

In this respect, before explaining the current embodiments of the string toy kit in detail, it is to be understood that the string toy kit is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the string toy kit.

It is therefore important that the claims be regarded as including such equivalent construction insofar as they do not depart from the spirit and scope of the string toy kit. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 2 is a detail view of an embodiment of the disclosure.
FIG. 3 is a detail view of an embodiment of the disclosure.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
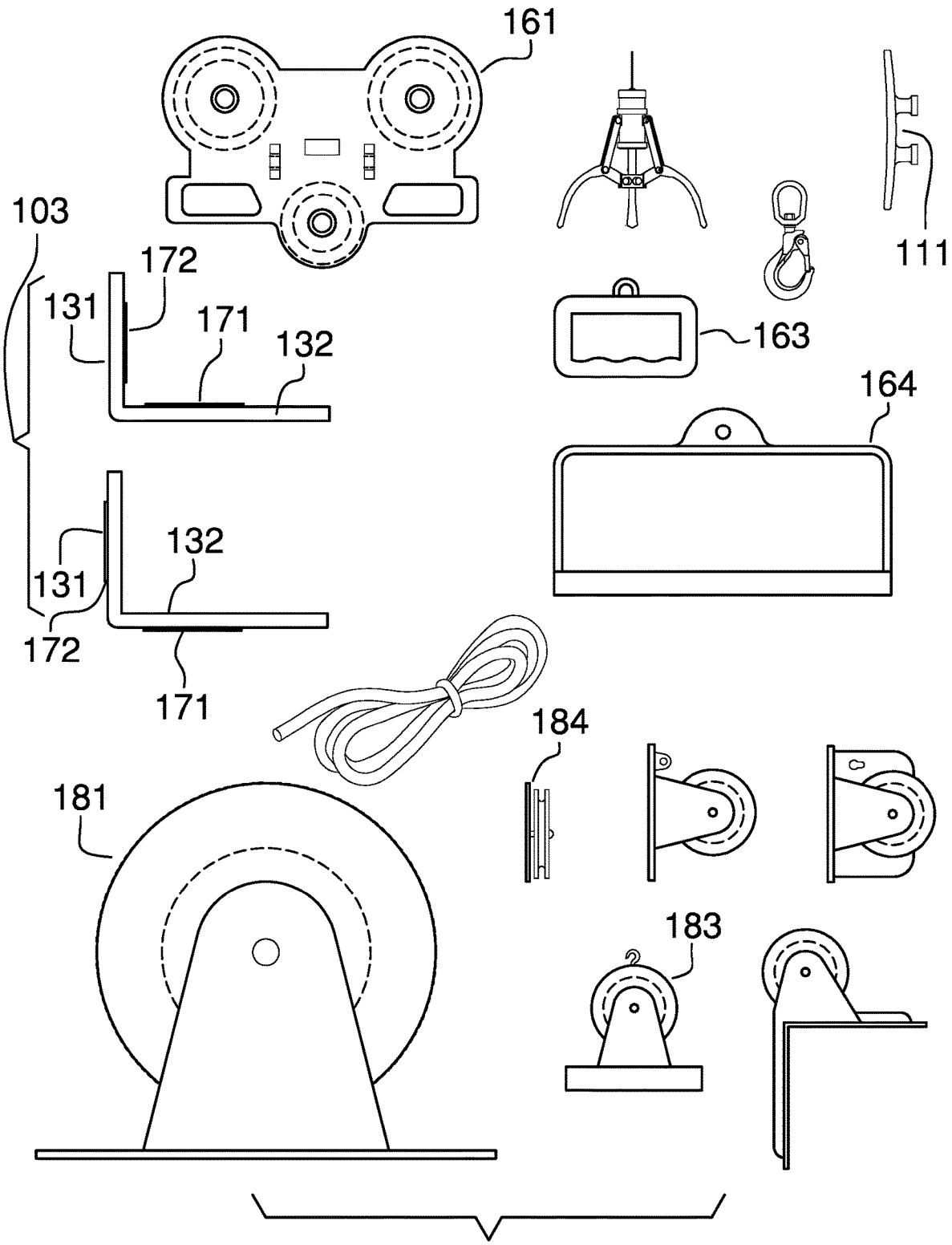
FIG. 1 is a kit view of an embodiment of the disclosure.
Figure 4:
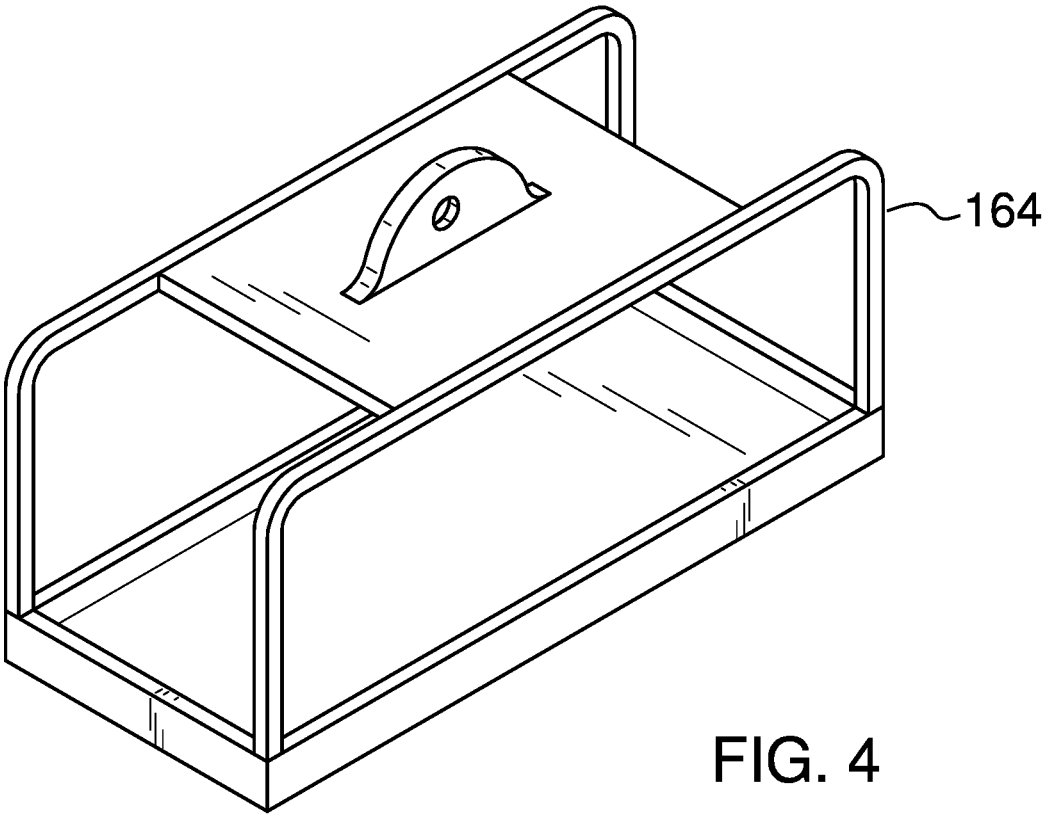
FIG. 4 is a detail view of an embodiment of the disclosure.
Figure 5:
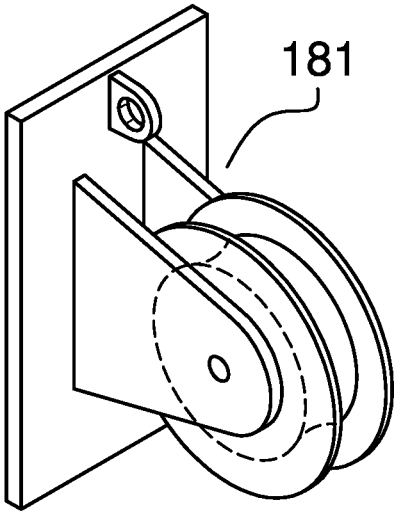
FIG. 5 is a detail view of an embodiment of the disclosure.
Figure 6:
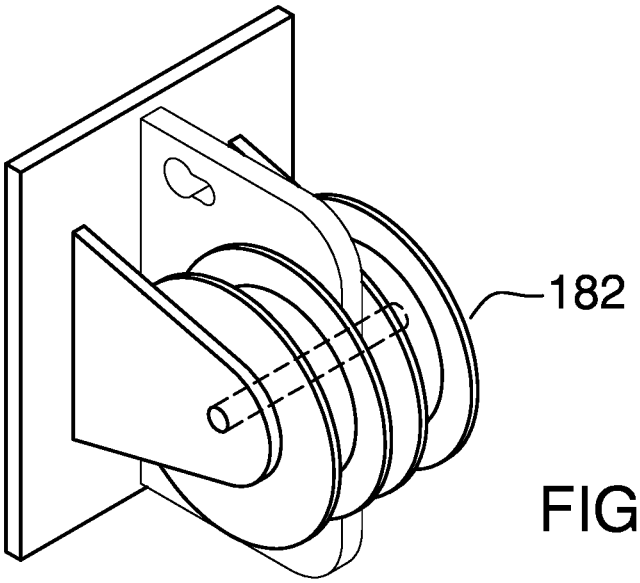
FIG. 6 is a detail view of an embodiment of the disclosure.
Figure 7:
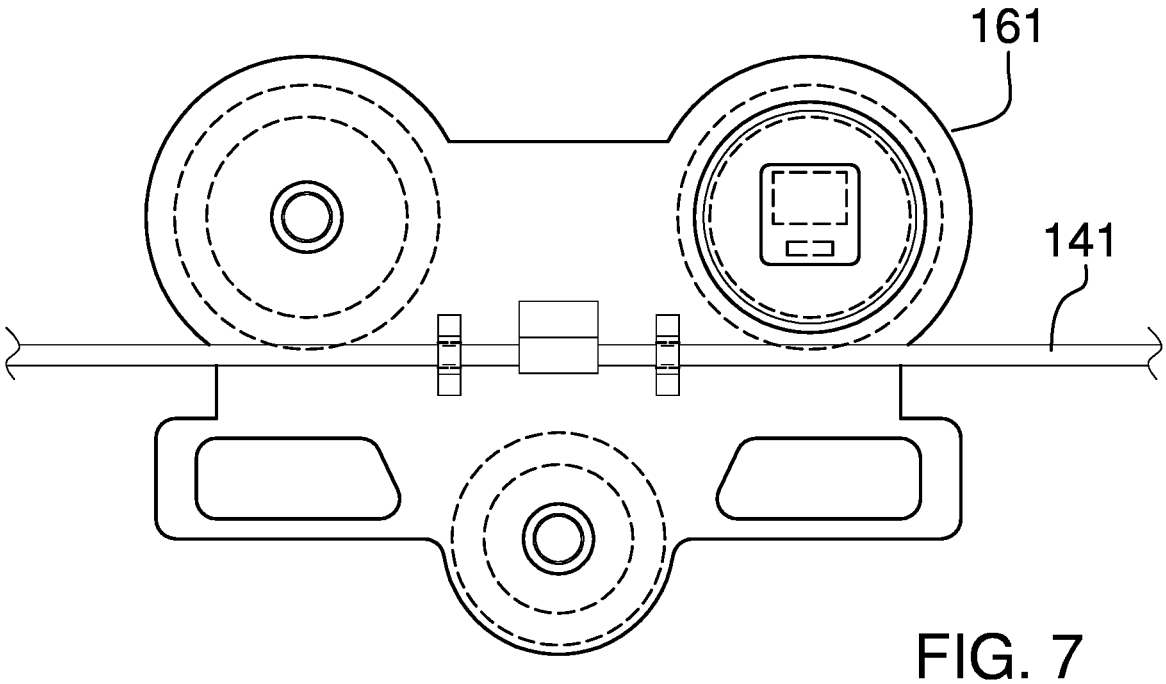
FIG. 7 is a detail view of an embodiment of the disclosure.
Figure 8:
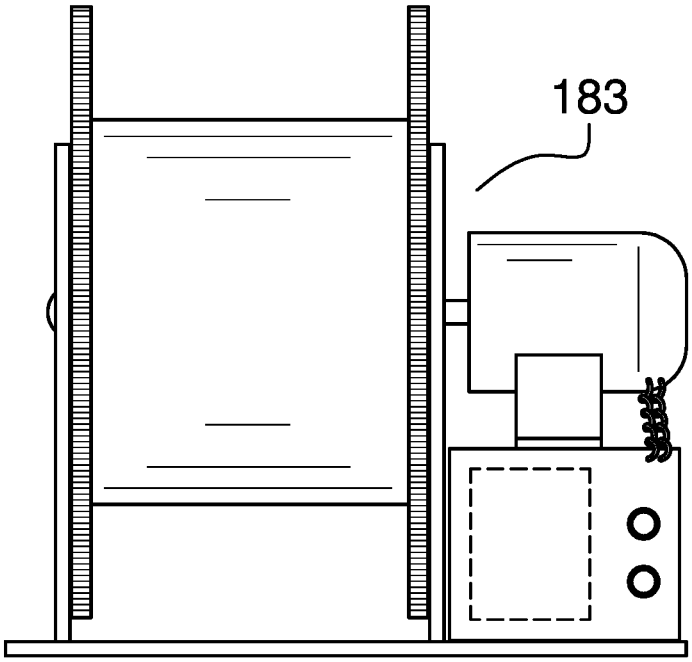
FIG. 8 is a detail view of an embodiment of the disclosure.
Figure 9:
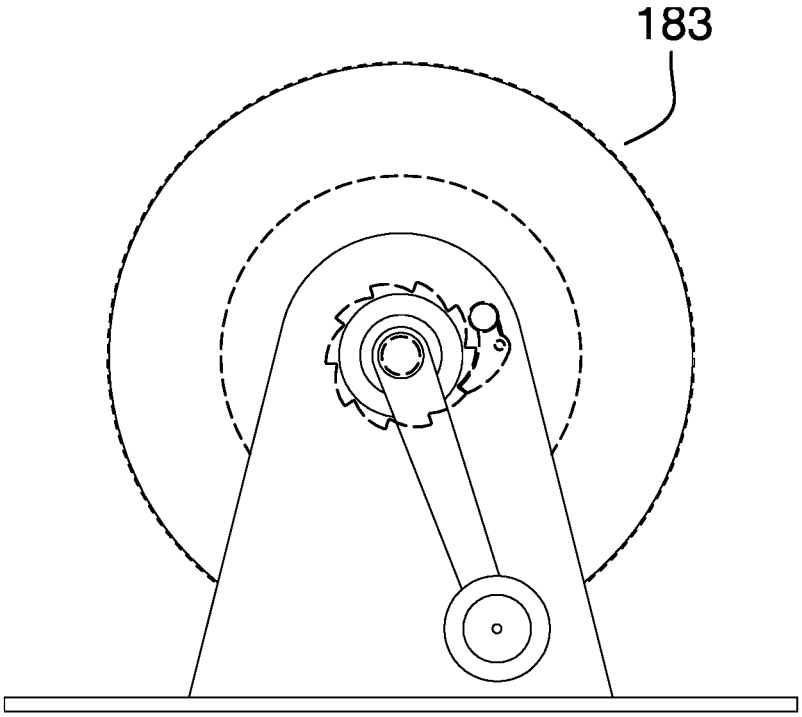
FIG. 9 is a detail view of an embodiment of the disclosure.
Figure 10:
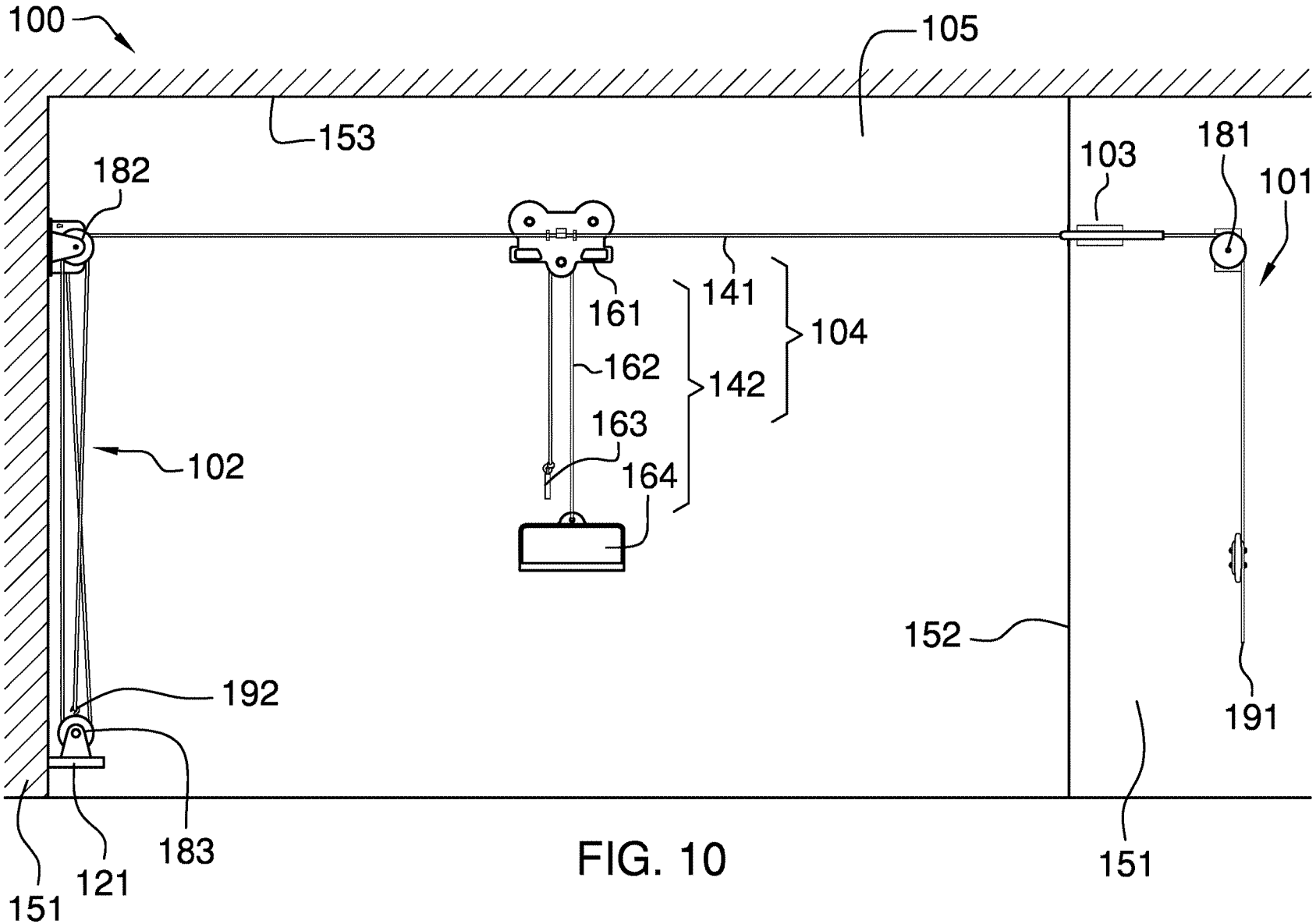
FIG. 10 is an in-use view of an embodiment of the disclosure.

Detailed reference will now be made to one or more potential embodiments of the disclosure, which are illustrated in FIGS. 1 through 10.

The string toy kit 100 (hereinafter invention) is a toy. The invention 100 is a vehicle. The vehicle formed by the invention 100 is often referred to as a zip line. The vehicle formed by the invention 100 is suspended above a supporting surface. The invention 100 comprises a base wall mount 101, a tension wall mount 102, a one or more corner guides 103, a zip line structure 104 and a chamber 105. The zip line structure 104 is suspended from the base wall mount 101, and tension wall mount 102, and the one or more corner guides 103. The chamber 105 comprises a plurality of walls 151, one or more corners 152, and a ceiling 153. The base wall mount 101, the tension wall mount 102, and the one or more corner guides 103 mount on the plurality of walls 151 of the chamber 105.

The chamber 105 is an enclosed negative space that is formed in a building. The chamber 105 forms the chamber 105 that contains the base wall mount 101, the tension wall mount 102, the one or more corner guides 103, and the zip line structure 104.

Each of the plurality of walls 151 is a vertically oriented barrier that encloses the negative space formed by the chamber 105. The base wall mount 101 mounts on a first wall selected from the plurality of walls 151. The tension wall mount 102 mounts on a second wall selected from the plurality of walls 151.

The one or more corners 152 refers to a brink that is formed between two adjacent walls selected from the plurality of walls 151. The individual corner guide 131 selected from the one or more corner guides 103 mounts around a corner selected from the one or more corners 152. Specifically, the individual corner guide 131 mounts around a corner selected from the group consisting of: a) a third wall selected from the plurality of walls 151 and the first wall selected from the plurality of walls 151; and, b) a third wall selected from the plurality of walls 151 and the second wall selected from the plurality of walls 151.

The ceiling 153 is a horizontally oriented surface that encloses the negative space formed by the chamber 105. The ceiling 153 forms the superior surface of the chamber 105.

The zip line structure 104 is a mechanical structure. The zip line structure 104 is an elevated structure. The zip line structure 104 attaches to the base wall mount 101, the tension wall mount 102, and the one or more corner guides 103. The zip line structure 104 forms the suspended vehicle of the zip line structure 104. The zip line structure 104 travels between a first structure and a second structure selected from the group consisting of the base wall mount 101, the tension wall mount 102 and an individual corner guide 131 selected from the one or more corner guides 103. The zip line structure 104 comprises a zip cord 141 and a zip line trolley 142.

The zip cord 141 is a cord. In the first potential embodiment of the disclosure, the zip cord 141 is a glow in the dark structure. The zip cord 141 is suspended above the supporting surface by the base wall mount 101 and the tension wall mount 102. A tension is placed on the zip cord 141 by the base wall mount 101 and the tension wall mount 102. The zip cord 141 comprises a first end 191 and a second end 192. The first end 191 is the end of the zip cord 141 attaches to the cleat 111 of the base wall mount 101. The second end 192 is the end of the zip cord 141 attaches to the third pulley 183 of the tension wall mount 102.

The zip line trolley 142 removably attaches to the zip cord 141. The zip cord 141 elevates the zip line trolley 142 above the supporting surface. The zip cord 141 forms a track that guides the direction of the motion of the zip line trolley 142 along the zip cord 141. The zip line trolley 142 is a mechanical structure. The zip line trolley 142 removably attaches to the zip cord 141. The zip line trolley 142 is a rotating structure. The rotating elements of the zip line trolley 142 attach to the zip cord 141 such that the rotation of the rotating elements causes the zip line trolley 142 moves along the track formed by the zip cord 141. The zip line trolley 142 is formed such that an object or an individual can be suspended from the zip line trolley 142. The zip line trolley 142 comprises a trolley structure 161, a suspension cord 162, a handle 163, and a basket 164.

The trolley structure 161 forms the vehicle of the zip line trolley 142. The trolley structure 161 removably attaches the zip line trolley 142 to the zip cord 141. The trolley structure 161 forms the rotating element of the zip line trolley 142. The rotation of the trolley structure 161 allows the zip line trolley 142 to move along the track formed by the zip cord 141. The trolley structure 161 suspends the suspension cord 162, the handle 163, and the basket 164 above the supporting surface.

The suspension cord 162, the handle 163, and the basket 164 attach to the trolley structure 161 such that the movement of the trolley structure 161 transports the suspension cord 162, the handle 163, and the basket 164 along the track formed by the zip cord 141. The suspension cord 162 is a cord. The suspension cord 162 physically attaches the handle 163 and the basket 164 to the trolley structure 161. The suspension cord 162 transfers the loads of the handle 163 and the basket 164 to the trolley structure 161 such that the suspension cord 162 suspends the handle 163 and the basket 164 above the supporting surface.

The handle 163 is a grip that is used to move the zip line trolley 142 along the track formed by the zip cord 141. The basket 164 is a pan shaped structure. The basket 164 forms a container that is suspended above the supporting surface by the trolley structure 161 and the suspension cord 162. The basket 164 is used to transport objects and individuals along the track formed by the zip cord 141.

The base wall mount 101 is a mechanical structure. The base wall mount 101 mounts on a first wall selected from the plurality of walls 151. The base wall mount 101 forms a first anchor point to which the zip cord 141 of the zip line structure 104. The base wall mount 101 forms a first load path that transfers the load of the zip line structure 104 to the chamber 105. The base wall mount 101 comprises a cleat 111 and a first pulley 181.

The cleat 111 is a mechanical structure. The cleat 111 attaches to the first wall of the chamber 105. The cleat 111 forms an anchor point to which the first end 191 of the zip cord 141 attaches.

The first pulley 181 is a pulley that mounts on the first wall selected from the plurality of walls 151. The first pulley 181 is a rotating structure. The first pulley 181 redirects the center axis of the zip cord 141 from a direction parallel to the first wall to a direction selected from the group consisting of: a) the tension wall mount 102; and, b) an individual corner guide 131 selected from the one or more corner guides 103.

The tension wall mount 102 is a mechanical structure. The tension wall mount 102 mounts on a second wall selected from the plurality of walls 151. The tension wall mount 102 forms a second anchor point to which the zip cord 141 of the zip line structure 104. The tension wall mount 102 forms a second load path that transfers the load of the zip line structure 104 to the chamber 105. The tension wall mount 102 generates an adjustable tension that is applied to the zip cord 141 of the zip line structure 104. The tension wall mount 102 comprises a weight structure 121, a second pulley 182, and a third pulley 183.

The weight structure 121 is a mechanical structure. The weight structure 121 removably attaches to the third pulley 183 of the tension wall mount 102. The attachment of the weight structure 121 increases the mass of the third pulley 183. The zip cord 141 of the zip line structure 104 elevates the weight structure 121 and the third pulley 183 above a supporting surface such that the action of the force of gravity on the weight structure 121 and the third pulley 183 applies a tension to the zip cord 141. The tension on the zip cord 141 is adjusted by replacing a first weight structure 121 attached to the third pulley 183 with a second weight structure 121 that has a mass the is different from the first weight structure 121.

The second pulley 182 is a double pulley that mounts on the second wall selected from the plurality of walls 151. The second pulley 182 is a rotating structure. The third pulley 183 is a pulley that is suspended from the second pulley 182. The third pulley 183 reverses the center axis of the zip cord 141 from a direction from the second pulley 182 back towards the second pulley 182. A first part of the second pulley 182 redirects the center axis of the zip cord 141 from a direction towards the base wall mount 101 to the direction towards the third pulley 183. A second part of the second pulley 182 reverses the center axis of the zip cord 141 from a direction from the third pulley 183 back towards the third pulley 183.

The one or more corner guides 103 is a mechanical structure. The one or more corner guides 103 comprises a collection of individual corner guides 131. Each individual corner guide 131 selected from the one or more corner guides 103 forms a track that guides the zip cord 141 around a corner selected from the one or more corner guides 103. Each individual corner guide 131 selected from the one or more corner guides 103 allows the invention 100 to accommodate the use of perpendicular walls selected from the plurality of walls 151.

Each individual corner guide 131 is a mechanical structure selected from the one or more corner guides 103. The individual corner guide 131 mounts around a corner selected from the one or more corners 152. The individual corner guide 131 forms a track that guides the zip cord 141 of the zip line structure 104 around the selected corner. The use of the individual corner guide 131 allows the invention 100 to be installed on two walls selected from the plurality of walls 151 that are perpendicular to each other. Each individual corner guide 131 comprises a corner tube 132, a first guide mount plate 171, a second guide mount plate 172, and a supplemental pulley 184.

The corner tube 132 is a non-Euclidean prism shaped structure. The corner tube 132 has a tubular structure. The curvature of the corner tube 132 wraps around the corner selected from the one or more corners 152. The corner tube 132 forms a protected space that allows the zip cord 141 to pass around the brink formed by the selected corner without the risk from damage by the edge of the brink.

The first guide mount plate 171 is a disk structure. The congruent ends of the disk structure of the first guide mount plate 171 have a rectangular shape. A congruent end of the disk structure of the first guide mount plate 171 attaches to the lateral face of the non-Euclidean prism structure of the corner tube 132. The first guide mount plate 171 forms a fastening structure that attaches the corner tube 132 to a wall selected from the group consisting of the first wall and the second wall.

The second guide mount plate 172 is a disk structure. The congruent ends of the disk structure of the second guide mount plate 172 have a rectangular shape. A congruent end of the disk structure of the second guide mount plate 172 attaches to the lateral face of the non-Euclidean prism structure of the corner tube 132 to the third wall. The second guide mount plate 172 forms a fastening structure that attaches the corner tube 132 to the third wall.

The supplemental pulley 184 is a pulley that mounts on the third wall selected from the plurality of walls 151. The supplemental pulley 184 is a rotating structure. The supplemental pulley 184 receives the zip cord 141 from the corner tube 132 of an individual corner guide 131 selected from the one or more corner guides 103. The supplemental pulley 184 redirects the center axis of the zip cord 141 from a direction parallel to the third wall to a direction selected from the group consisting of: a) the tension wall mount 102; and, b) an individual corner guide 131 selected from the one or more corner guides 103.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Angle Plate and Bent Plate: As used in this disclosure, an angle plate is a rectangular plate that is bent to form a right angle such that the brink formed by the right angle runs parallel to the major axis of the rectangular plate. When formed from metal, an angle plate is often referred to as an angle iron. A bent plate is a rectangular plate that is bent to form a right angle such that the brink formed by the right angle runs parallel to the minor axis of the rectangular plate. When formed from metal, an angle plate is often referred to as an angle iron.

Barrier: As used in this disclosure, a barrier is a physical obstacle that forms a boundary between a first space and a second space. The barrier prevents the passage of an object between the first space and the second space.

Brink: As used in this disclosure, a brink refers to the edge or line formed by the intersection of a first plane or surface and a second plane or surface wherein a cant exists between the first plane or surface and the second plane or surface.

Building: As used in this disclosure, a building is a structure located a fixed position that forms one or more enclosable spaces. The building forms a space selected from the group consisting of a protected space or a protection space. A building is often referred to as a structure.

Cant: As used in this disclosure, a cant is an angular deviation from one or more reference lines (or planes) such as a vertical line (or plane) or a horizontal line (or plane).

Carabiner: As used in this disclosure, a carabiner is coupling link that is usually formed as an oblong metal ring with one spring hinged side that is used to open and close the ring. Synonyms for carabiner include D-link. A carabiner that has the ability to lock the spring hinged side into a closed position is called a locking carabiner.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Ceiling: As used in this disclosure a ceiling refers to either: 1) the superior horizontal surface of a chamber that is distal from the floor; 2) the superior horizontal surface of a structure; or, 3) the upper limit of a range. A floor and a ceiling can refer to the same structure wherein the selection depends solely on the point of view of the user. The selection of this definition depends on the context. In situations where the context is unclear the first definition should be used.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chamber: As used in this disclosure, a chamber is an enclosed or enclosable space within a building.

Cleat: As used in this disclosure, a cleat is an object around which a rope, cord, or wire can be secured.

Clutch: As used in this disclosure, a clutch is a mechanical device that attaches and detaches a first rotating device to and from a second device that provides the energy required to rotate the first rotating device.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Exterior: As used in this disclosure, the exterior is used as a relational term that implies that an object is not contained within the boundary of a structure or a space.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Major and Minor Axes: As used in this disclosure, the major and minor axes refer to a pair of perpendicular axes that are defined within a structure. The length of the major axis is always greater than or equal to the length of the minor axis. The major axis is always the longest diameter of the of the perimetrical boundary of the structure. The major and minor axes intersect at the center of the perimetrical boundary of the structure. The major axis is always parallel to the longest edge of a rectangular structure.

Mass: As used in this disclosure, refers to a quantity of matter within a structure. Mass is measured and quantified by the reaction of the structure to a force. Mass can also be roughly quantified as a function of atomic composition and the number of atoms contained within the structure. The term weight refers to the quantification of a mass that is exposed to the force of gravity.

Motor: As used in this disclosure, a motor refers to the method of transferring energy from an external power source into rotational mechanical energy.

Negative Space: As used in this disclosure, negative space is a method of defining an object through the use of open or empty space as the definition of the object itself, or, through the use of open or empty space to describe the boundaries of an object.

Non-Euclidean Disk: As used in this disclosure, a non-Euclidean structure is a disk-shaped structure wherein the congruent end (faces) of the disk structure lies on a non-Euclidean plane.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Non-Euclidean Prism: As used in this disclosure, a non-Euclidean prism is a prism structure wherein the center axis of the prism lies on a non-Euclidean plane or is otherwise formed with a curvature.

Non-Euclidean Structure: As used in this disclosure, a non-Euclidean structure is a structure wherein: a) the non-Euclidean structure is formed with a non-Euclidean plane; b) the non-Euclidean structure has an axis that lies on a non-Euclidean plane or is otherwise formed with a curvature; or, c) a combination of both (a) and (b) above.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Surface: As used in this disclosure, a protected surface is a first surface that is separated from a second surface by a boundary structure. The boundary structure forms a barrier that protects objects resting on the protected surface from potential dangers on the other side of the boundary.

Protection Space: As used in this disclosure, a protection space is a space formed by a boundary structure. The boundary structure forms a protective barrier that protects objects outside the protection space from potential dangers from the operation of a device or process contained within the protection space.

Pulley: As used in this disclosure a pulley is a wheel with a grooved rim around which a cord (or other form of rope, line, or cable) passes. The pulley is used to change the direction of a force applied to the cord.

Roller Clutch and Spring System: As used in this disclosure, a roller clutch and spring system is a commercially available system for storing a sheeting on a scroll or loading a cord on a spool. The sheeting is stored on a rotating cylindrical roller as the scroll. The cord is stored on the spool. The clutch portion of the roller clutch and spring system is configured to allow the rotating cylindrical roller to rotate in a first direction. The spring portion of the roller clutch and spring system is configured to return the rotating cylindrical roller to its original position when the clutch portion is released. A common example of the roller clutch and spring system is the mechanism used to raise and lower window blinds.

Spool: As used in this disclosure, a spool is a cylindrical device upon which a flexible material, including but not limited to a sheeting, yarn, a cord, or a tape, can be wound. Depending on context, a spool may also contain the flexible material stored upon the spool.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Suspend: As used in this disclosure, to suspend an object means to support an object such that the inferior end of the object does not form a significant portion of the load path of the object. Include inferior superior and load path.

Track: As used in this disclosure, a track is a device that is used to control the path of motion of an object.

Trolley: As used in this disclosure, a trolley is a mechanical structure that suspends an object to a jib or a track such that the position of the object relative to the jib or track is adjustable.

Vehicle: As used in this disclosure, a vehicle is a device that is used for transporting passengers, goods, or equipment. The term motorized vehicle specifically refers to a vehicle can move under power provided by an electric motor or an internal combustion engine. The term vehicle generically applies to motorized vehicles and vehicles without a motor. A motorized vehicle further comprises an electrical system that can be used as a source of electric energy. The enclosed passenger space of a vehicle is known as a cab.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wall: As used in this disclosure, a wall is a vertical surface that forms a boundary of a room or chamber.

With respect to the above description, it is to be realized that the optimum dimensional relationship for the various components of the invention described above and in FIGS. 1 through 10 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A string toy kit comprising a plurality of items that are used to form at least one zip line across a chamber;

wherein the plurality of items is used in a modular capacity such that the at least one zip line can be redesigned;

wherein the chamber comprises a plurality of walls, one or more corners, and a ceiling;

wherein the at least one zip line is a zip line structure that travels between a first structure and a second structure;

wherein the chamber is an enclosed negative space that is formed in a building;

wherein the plurality of items comprises a base wall mount, a tension wall mount, a one or more corner guides, the zip line structure;

wherein the base wall mount, the tension wall mount, and the one or more corner guides mount on the plurality of walls of the chamber;

wherein the zip line structure is suspended from the base wall mount, and tension wall mount, and the one or more corner guides;

wherein the base wall mount mounts on a first wall selected from the plurality of walls;

wherein the tension wall mount mounts on a second wall selected from the plurality of walls.

2. The string toy kit according to claim 1 wherein the string toy kit is a toy;

wherein the string toy kit is a vehicle;

wherein the vehicle formed by the string toy kit is suspended above a supporting surface;

wherein each of the plurality of walls is a vertically oriented barrier that encloses the negative space formed by the chamber.

3. The string toy kit according to claim 2 wherein the chamber contains the base wall mount, the tension wall mount, the one or more corner guides, and the zip line structure;

wherein the one or more corners refers to a brink that is formed between two adjacent walls selected from the plurality of walls;

wherein the individual corner guide selected from the one or more corner guides mounts around a corner selected from the one or more corners;

wherein the individual corner guide mounts around a corner selected from the group consisting of: a) a third wall selected from the plurality of walls and the first wall selected from the plurality of walls; and, b) a third wall selected from the plurality of walls and the second wall selected from the plurality of walls;

wherein the ceiling is a horizontally oriented surface that encloses the negative space formed by the chamber;

wherein the ceiling forms the superior surface of the chamber.

4. The string toy kit according to claim 3 wherein the zip line structure is a mechanical structure;

wherein the zip line structure is an elevated structure;

wherein the zip line structure attaches to the base wall mount, the tension wall mount, and the one or more corner guides;

wherein the zip line structure forms the suspended vehicle of the zip line structure;

wherein the zip line structure travels between a first structure and a second structure selected from the group consisting of the base wall mount, the tension wall mount and an individual corner guide selected from the one or more corner guides.

5. The string toy kit according to claim 4 wherein the zip line structure comprises a zip cord and a zip line trolley;

wherein the zip cord is a cord;

wherein the zip cord is suspended above the supporting surface by the base wall mount and the tension wall mount;

wherein a tension is placed on the zip cord by the base wall mount and the tension wall mount;

wherein the zip cord comprises a first end and a second end;

wherein the first end attaches to the base wall mount;

wherein the second end attaches to the tension wall mount;

wherein the zip line trolley removably attaches to the zip cord;

wherein the zip cord elevates the zip line trolley above the supporting surface;

wherein the zip cord forms a track that guides the direction of the motion of the zip line trolley along the zip cord;

wherein the zip line trolley is a mechanical structure;

wherein the zip line trolley removably attaches to the zip cord;

wherein the zip line trolley is a rotating structure;

wherein the rotating elements of the zip line trolley attach to the zip cord such that the rotation of the rotating elements causes the zip line trolley moves along the track formed by the zip cord.

6. The string toy kit according to claim 5 wherein the zip line trolley comprises a trolley structure, a suspension cord, a handle, and a basket;

wherein the trolley structure forms the vehicle of the zip line trolley;

wherein the trolley structure removably attaches the zip line trolley to the zip cord;

wherein the trolley structure forms the rotating element of the zip line trolley;

wherein the rotation of the trolley structure allows the zip line trolley to move along the track formed by the zip cord;

wherein the trolley structure suspends the suspension cord, the handle, and the basket above the supporting surface;

wherein the suspension cord, the handle, and the basket attach to the trolley structure such that the movement of the trolley structure transports the suspension cord, the handle, and the basket along the track formed by the zip cord;

wherein the suspension cord is a cord;

wherein the suspension cord physically attaches the handle and the basket to the trolley structure;

wherein the suspension cord transfers the loads of the handle and the basket to the trolley structure such that the suspension cord suspends the handle and the basket above the supporting surface;

wherein the handle is a grip that is used to move the zip line trolley along the track formed by the zip cord;

wherein the basket is a pan shaped structure;

wherein the basket forms a container that is suspended above the supporting surface by the trolley structure and the suspension cord.

7. The string toy kit according to claim 6 wherein the base wall mount is a mechanical structure;

wherein the base wall mount mounts on a first wall selected from the plurality of walls;

wherein the base wall mount forms a first anchor point to which the zip cord of the zip line structure;

wherein the base wall mount forms a first load path that transfers the load of the zip line structure to the chamber.

8. The string toy kit according to claim 7 wherein the tension wall mount is a mechanical structure;

wherein the tension wall mount mounts on a second wall selected from the plurality of walls;

wherein the tension wall mount forms a second anchor point to which the zip cord of the zip line structure;

wherein the tension wall mount forms a second load path that transfers the load of the zip line structure to the chamber;

wherein the tension wall mount generates an adjustable tension that is applied to the zip cord of the zip line structure.

9. The string toy kit according to claim 8 wherein the one or more corner guides is a mechanical structure;

wherein the one or more corner guides comprises a collection of individual corner guides;

wherein each individual corner guide selected from the one or more corner guides forms a track that guides the zip cord around a corner selected from the one or more corner guides;

wherein each individual corner guide selected from the one or more corner guides allows the string toy kit to accommodate the use of perpendicular walls selected from the plurality of walls;

wherein each individual corner guide is a mechanical structure selected from the one or more corner guides;

wherein the individual corner guide mounts around a corner selected from the one or more corners;

wherein the individual corner guide forms a track that guides the zip cord of the zip line structure around the selected corner;

wherein the use of the individual corner guide allows the string toy kit to be installed on two walls selected from the plurality of walls that are perpendicular to each other.

10. The string toy kit according to claim 9 wherein the base wall mount comprises a cleat and a first pulley;

wherein the cleat is a mechanical structure;

wherein the cleat attaches to the first wall of the chamber;

wherein the cleat forms an anchor point to which the first end of the zip cord attaches;

wherein the first end is the end of the zip cord attaches to the cleat of the base wall mount;

wherein the first pulley is a pulley that mounts on the first wall selected from the plurality of walls;

wherein the first pulley is a rotating structure;

wherein the first pulley redirects the center axis of the zip cord from a direction parallel to the first wall to a direction selected from the group consisting of: a) the tension wall mount; and, b) an individual corner guide selected from the one or more corner guides.

11. The string toy kit according to claim 10 wherein the tension wall mount comprises a weight structure, a second pulley, and a third pulley;

wherein the weight structure is a mechanical structure;

wherein the weight structure removably attaches to the third pulley of the tension wall mount;

wherein the attachment of the weight structure increases the mass of the third pulley;

wherein the zip cord of the zip line structure elevates the weight structure and the third pulley above a supporting surface such that the action of the force of gravity on the weight structure and the third pulley applies a tension to the zip cord;

wherein the tension on the zip cord is adjusted by replacing a first weight structure attached to the third pulley with a second weight structure that has a mass the is different from the first weight structure;

wherein the second pulley is a double pulley that mounts on the second wall selected from the plurality of walls;

wherein the second pulley is a rotating structure;

wherein the third pulley is a pulley that is suspended from the second pulley;

wherein the third pulley reverses the center axis of the zip cord from a direction from the second pulley back towards the second pulley;

wherein a first part of the second pulley redirects the center axis of the zip cord from a direction towards the base wall mount to the direction towards the third pulley;

wherein a second part of the second pulley reverses the center axis of the zip cord from a direction from the third pulley back towards the third pulley;

wherein the second end is the end of the zip cord attaches to the third pulley of the tension wall mount.

12. The string toy kit according to claim 11 wherein each individual corner guide comprises a corner tube, a first guide mount plate, a second guide mount plate, and a supplemental pulley;

wherein the corner tube is a non-Euclidean prism shaped structure;

wherein the corner tube has a tubular structure;

wherein the curvature of the corner tube wraps around the corner selected from the one or more corners;

wherein the corner tube forms a protected space that allows the zip cord to pass around the brink formed by the selected corner without the risk from damage by the edge of the brink;

wherein the first guide mount plate is a disk structure;

wherein the congruent ends of the disk structure of the first guide mount plate have a rectangular shape;

wherein a congruent end of the disk structure of the first guide mount plate attaches to the lateral face of the non-Euclidean prism structure of the corner tube;

wherein the first guide mount plate forms a fastening structure that attaches the corner tube to a wall selected from the group consisting of the first wall and the second wall;

wherein the second guide mount plate is a disk structure;

wherein the congruent ends of the disk structure of the second guide mount plate have a rectangular shape;

wherein a congruent end of the disk structure of the second guide mount plate attaches to the lateral face of the non-Euclidean prism structure of the corner tube to the third wall;

wherein the second guide mount plate forms a fastening structure that attaches the corner tube to the third wall;

wherein the supplemental pulley is a pulley that mounts on the third wall selected from the plurality of walls;

wherein the supplemental pulley is a rotating structure;

wherein the supplemental pulley receives the zip cord from the corner tube of an individual corner guide selected from the one or more corner guides;

wherein the supplemental pulley redirects the center axis of the zip cord from a direction parallel to the third wall to a direction selected from the group consisting of: a) the tension wall mount; and, b) an individual corner guide selected from the one or more corner guides.

* * * * *